US005647470A

United States Patent [19]

Bruner et al.

[11] Patent Number: 5,647,470

[45] Date of Patent: Jul. 15, 1997

[54] TAMPER RESISTANT COIN RACE

[75] Inventors: Philemon L. Bruner; David C. Bugge, both of Houston, Tex.

[73] Assignee: Imonex Services Inc., Katy, Tex.

[21] Appl. No.: 602,267

[22] Filed: Feb. 16, 1996

Related U.S. Application Data

[63] Continuation of Ser. No. 437,211, May 8, 1995, abandoned, which is a continuation of Ser. No. 67,687, May 26, 1993, abandoned.

[51] Int. Cl.[6] ..... G07F 1/04

[52] U.S. Cl. ..... 194/347; 194/351

[58] Field of Search ..... 194/338, 345, 194/347, 348, 349, 351; 453/5, 9, 14, 15

[56] References Cited

U.S. PATENT DOCUMENTS

| | | | |
|---|---|---|---|
| 732,746 | 7/1903 | Jaeger | 194/338 |
| 1,933,752 | 11/1933 | Parks et al. | 194/334 X |
| 4,842,120 | 6/1989 | Dobbins et al. | 194/349 |
| 4,878,573 | 11/1989 | Kobayashi et al. | 194/338 |
| 4,911,280 | 3/1990 | Bruner | 194/345 X |
| 5,027,937 | 7/1991 | Parish et al. | 194/348 |
| 5,156,250 | 10/1992 | Parish et al. | 194/348 |

FOREIGN PATENT DOCUMENTS

| | | | |
|---|---|---|---|
| 2428528A1 | 1/1976 | Germany | 194/349 |

*Primary Examiner*—F. J. Bartuska
*Attorney, Agent, or Firm*—Arnold White & Durkee

[57] ABSTRACT

A tamper resistant coin race is provided which establishes a non-linear coin race or path for the coin to traverse. The structure defining the coin race provides communication from the coin race to the exterior to prevent the locking of the coin race by the insertion of foreign matter. Structures are also provided to further limit the insertion of probes into the coin race.

1 Claim, 4 Drawing Sheets

FIG. 2
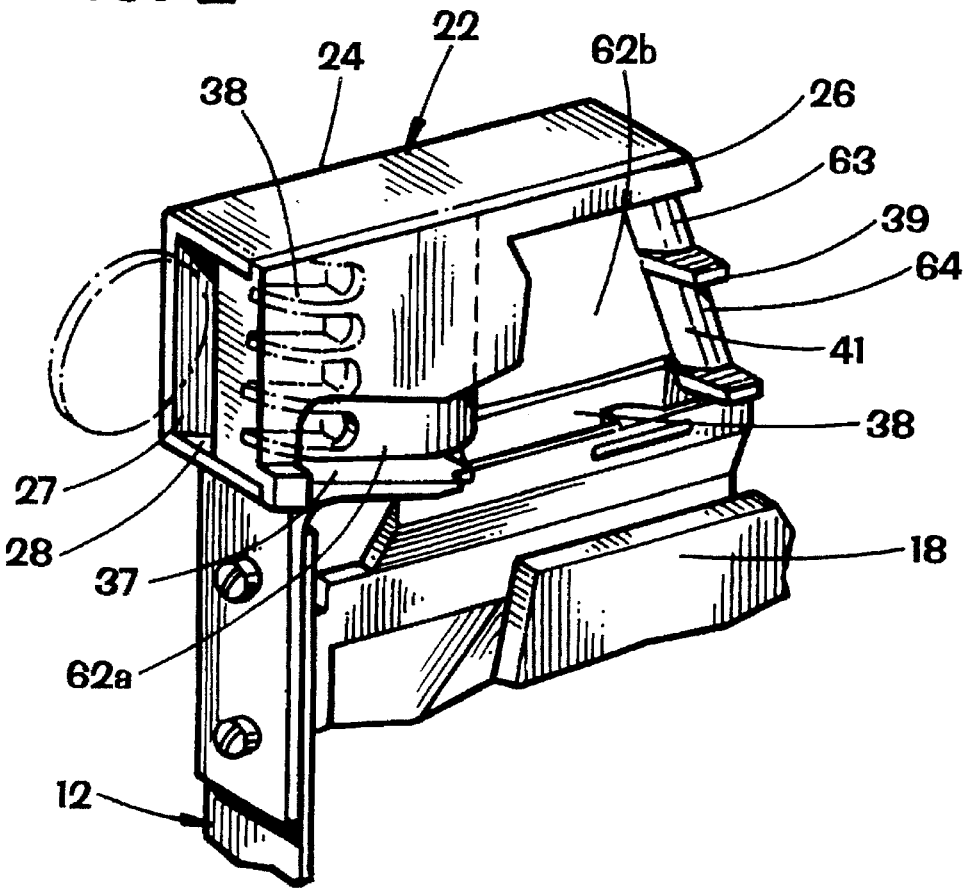
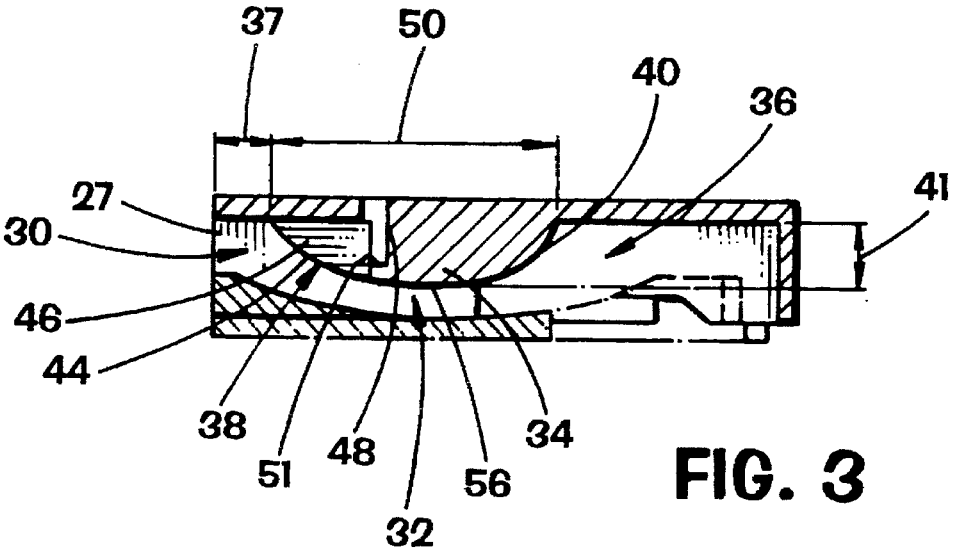
FIG. 3

TAMPER RESISTANT COIN RACE

This is a continuation of Ser. No. 08/437,21 filed May 8, 1995, now abandoned; which is a continuation of Ser. No. 08/067,687 filed May 26, 1993, now abandoned.

BACKGROUND 0F THE INVENTION

The present invention relates generally to coin acceptance and collection mechanisms, and more specifically relates to methods and apparatus for minimizing adverse effects due to attempts to tamper with such mechanisms.

As is well-known, coin acceptance and collection systems are utilized in a wide variety of applications, including telephones, vending machines, etc. A current problem affecting the owners or operators of such systems is the tampering with the systems to attempt to recover deposited coins from the system.

One common current form of this type of vandalism consists of packing or "stuffing" the mechanism with a blocking element, such as a straw or wad of paper in such a way as to block the coin race above the coin acceptance portion of the collection system, but far enough inside the machine to facilitate the collection of a number of coins in the machine. When a machine has been stuffed in this manner, the machine will accept coins, but will not register them, and thus will not operate for the customer depositing the coins. The vandal will periodically access the machine, inserting a probe, such as a rod or other member, into the coin receptor slot to move the stuffing out of position while simultaneously actuating the coin return to facilitate rejection of the Coins by the machine and the exit of the coins through the coin return. The vandal will typically then restuff the coin race to repeat the operation.

In addition to the defrauding of the customer, this vandalism has other substantial detriments. For example, the repeated stuffing and unstuffing of the machine with the rod or other tool can cause damage to the coin acceptance system, eventually requiring its replacement. Further, customers angered by the loss of their money without the resulting machine function are sometimes known to vent their frustrations on the machine, leading to significant damage. This type of vandalism, therefore, represents a serious problem to the coin-operated machine industry.

Existing attempts to solve the above problem have included the use of a coin receptor slot cover which is moveable to substantially cover the coin slot when the coin return is actuated. One example of this type of system is disclosed in U.S. Pat. No. 4,842,120. Such systems, while useful in making vandalism more difficult, are not entirely successful in preventing the occurrence, or in preventing damage to the coin acceptance apparatus or the machine with which it is associated.

Accordingly, the present invention provides a new method and apparatus for establishing a coin race which is resistant to tampering, and particularly to stuffing of the coin race. In a preferred embodiment, such system is also operative to minimize, if not prevent, defrauding of customers, and to minimize damage to the coin acceptance apparatus.

SUMMARY OF THE INVENTION

The invention includes a coin receiving assembly which includes a defined non-linear coin race to minimize the effects of tampering, such as by stuffing the race. The coin receiving assembly includes a housing assembly which defines the coin race. In a preferred embodiment, the coin receiving assembly will include a receiving coin race with at least two general portions generally laterally offset from one another, and will include an aperture providing communication from the receiving coin race to a location external to the race. In a particularly preferred embodiment, the coin race includes three general portions. The first portion communicates with a coin entrance slot which will communicate with the coin deposit slot on the machine in which the coin receiving assembly is installed. The third portion includes a coin exit which will communicate to a coin acceptance assembly. The second, intermediate, portion of the coin race is laterally offset from at least the first portion of the coin race in the first direction, and is also preferably laterally offset from the third portion of the coin race in a second direction. In one preferred embodiment, the first and third portions will be generally aligned, while only the second portion is generally offset relative thereto. Further, in a particularly preferred embodiment, the second portion defines a curvilinear path in the coin race. A coin will thus move from the first portion to the third portion in a generally tangential relation to the contours of the surface defining the inside of the second portion of the coin race.

The housing assembly also preferably includes an aperture communicating the interior of the coin race to the exterior of the housing. This aperture preferably communicates with at least the first and second portions of the coin race and most preferably communicates with all three portions of the race, such aperture, in combination with the non-linear race minimizes the capability of stuffing materials into the coin race.

Additionally, in a particularly preferred embodiment, the coin race of the coin receiving assembly is defined by surfaces which include one, or preferably a plurality, of recesses therein. Further, each of these recesses preferably terminates in an undercut which provides a lip or flange of material between an inner-most portion of the recess and the defined coin race. These recesses and undercuts, serve to limit the movement of any foreign object, such as a probe, which is attempted to be inserted into the assembly along the coin race.

The present invention further contemplates a complete coin acceptance apparatus which includes a coin receptor slot cover operatively associated with the coin return such that actuation of the coin return partially, or preferably completely, covers the coin receptor slot, thereby further limiting the capability of vandals to insert foreign objects into the receiving coin race.

BRIEF DESCRIPTION OF THE DRAWINGS

FIG. 2 depicts the system of FIG. 1 in partial cutaway view to better depict the tamper resistant coin race.

FIG. 3 is a cross-sectional view of the tamper resistant coin race of FIGS. 1 and 2 along line 2 in FIG. 1.

DETAILED DESCRIPTION OF THE PREFERRED EMBODIMENT

Figure 1:
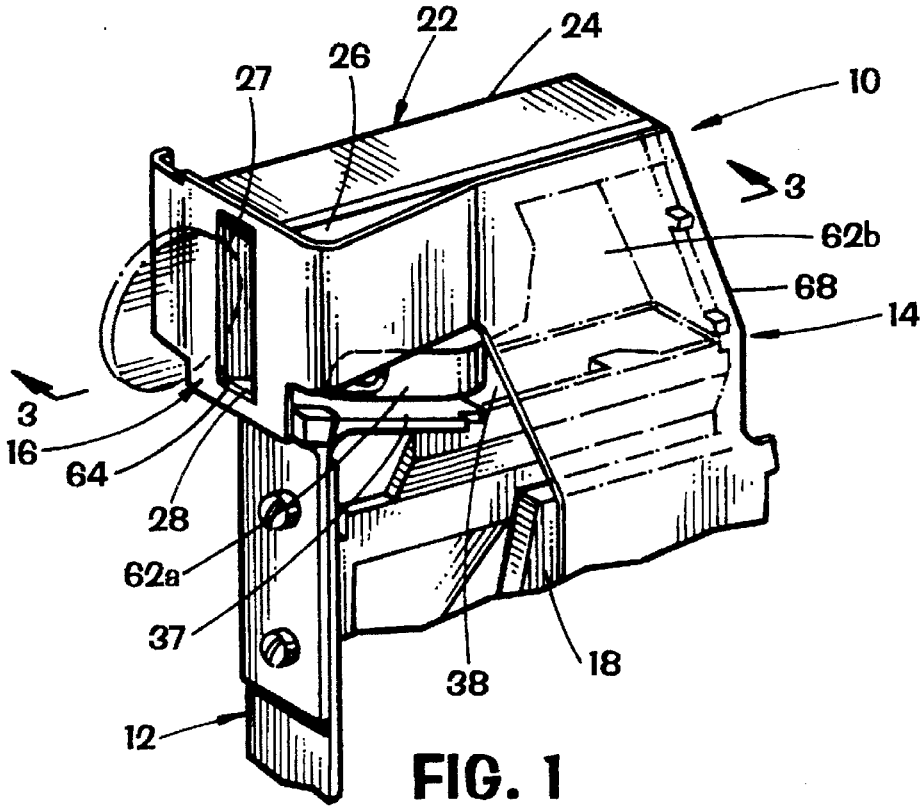
FIG. 1 depicts an exemplary tamper resistant coin race in accordance with the present invention, disposed in an exemplary operative relation to a coin acceptance assembly, also forming a system in accordance with the present invention.

Referring now to the drawings in more detail, and particularly to FIG. 1, therein is depicted the exemplary tamper resistant coin race assembly in accordance with the present invention, indicated generally at 10. The tamper resistant coin race assembly 10 is depicted coupled to a coin acceptance assembly 12 to form a coin collection system 14. Coin acceptance assembly 12 may be of any of a number of well-known types. For example, the coin acceptance assembly 12 may be constructed in accordance with U.S. Pat. No. 4,911,280, issued Mar. 27, 1992, to Philemon L. Brunet. The disclosure of U.S. Pat. No. 4,911,280 is hereby incorporated herein for all purposes.

As described herein the coin acceptance assembly includes a mechanism which collects coins, and may, in some applications, separate coins of different sizes. The coin race assembly does not perform these functions, but serves as a coin receiving unit to receive coins inserted into a machine and to communicate them to a coin collection assembly while minimizing tampering.

Briefly, the described coin acceptance assembly 12 receives coins proximate an upper end and the coins travel through a downwardly-extending coin race. As a coin travels downwardly through the race, a number of generally laterally-oriented forces are applied to the coin, causing the coin to be deflected through a sequential number of paths or courses. As the coin travels through these various courses, the coin may pass into an aperture, depending upon its size, thereby causing separation of different sizes of coins.

Also as described in U.S. Pat. No. 4,911,280, the system may be formed of hinged segments which may be moved relative to one another through actuation of a lever to result in the release of coins from the assembly. As depicted in FIG. 1 herein, a coin slot receptor blocking assembly 16 is shown coupled to one of these relatively-hinged segments 18. Such segment 18 would be relatively moveable relative to, for example, housing assembly 20 of coin collection assembly 12.

Coin slot receptor blocking assembly 16 includes a plate, preferably formed of metal, which moves with hinged segment 18, to shift laterally upon actuation of the machine coin return, as will be further described later herein.

Figure 4:
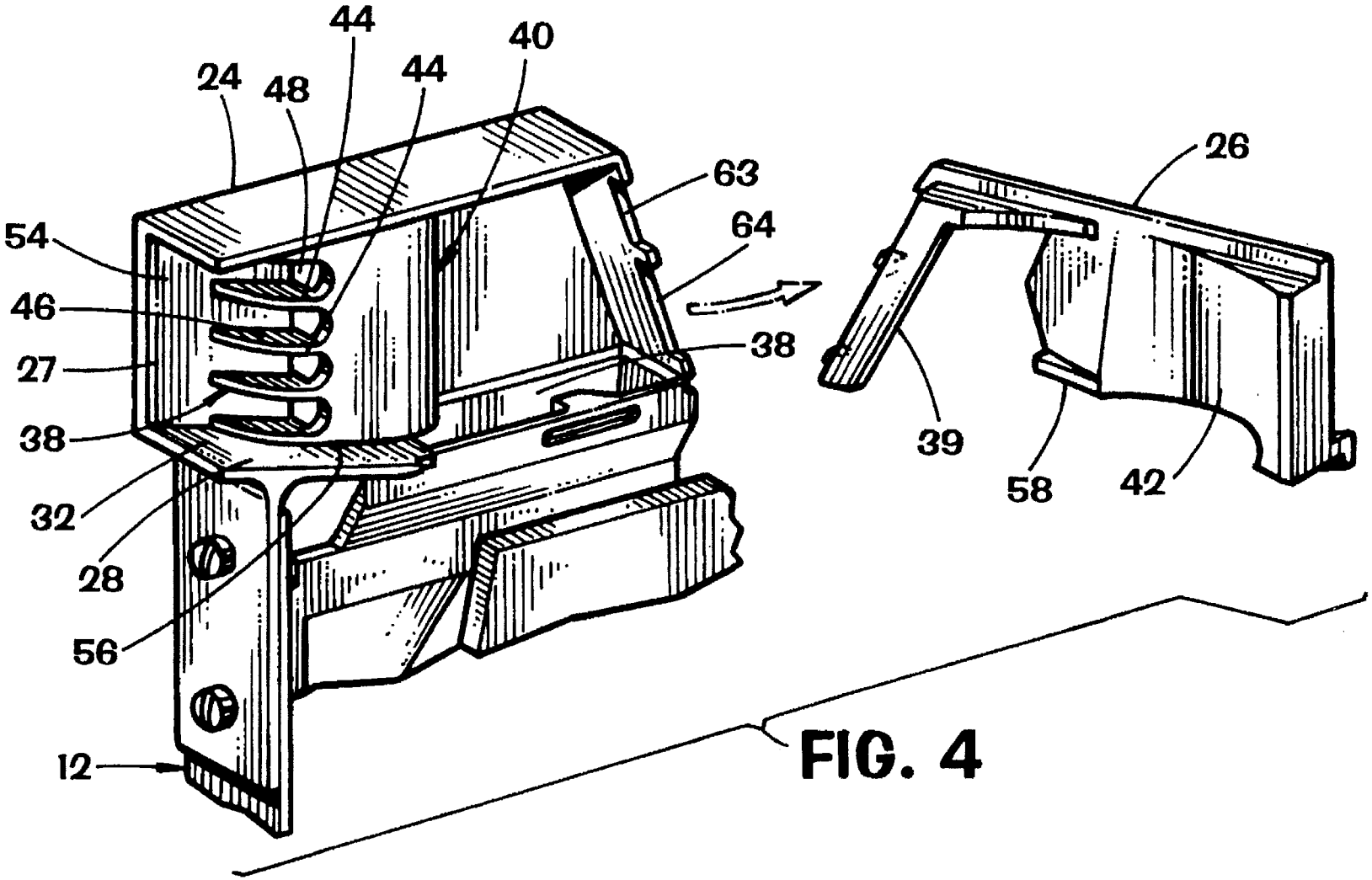
FIG. 4 depicts the housing assembly of the tamper resistant coin race of FIGS. 1 and 2 in an exploded view, showing the internal contours thereof.

Referring now also to FIGS. 2–4, the structure of tamper resistant coin race assembly 10 may be seen in greater detail. Tamper resistant coin race assembly 10 includes a housing assembly, indicated generally at 22. The coin race housing assembly 22 includes a body 24 and a cover 26. Body 24 and cover 26 may be formed of any suitable material, for example, materials such as Norel™, ABS, Nylon™, or Lexan™, may be suitable. Of course, other materials, such as metal, may also be utilized; or different materials may be used for different portions of coin race assembly 10. Body portion 24 and cover portion 26 may be secured together by any appropriate mechanism. For disassembly, the two components may be coupled together by screws (not illustrated), or the two members could be glued together to form a single, non-disassembleable unit.

Body 24 and cover 26 cooperatively define a coin entrance 27 and a coin race, indicated generally at 28. Coin race 28 preferably includes three primary zones or portions. A first portion 30, including coin entrance 27, will lie in general registry with a coin insertion slot of a machine when assembly 14 is installed in an intended operating environment. A second portion 32 is defined to one side of a deflecting contour 34, thereby laterally offsetting second portion 32 of coin race 28 from first portion 30. A third portion 36 of coin race 28 is formed beyond deflecting contour 34. Third portion 36 will communicate directly with a coin inlet 38 of coin collection assembly 12. Also, as depicted in the illustrative embodiment, first portion 30 of coin race 28 and third portion 36 of coin race 28 may be arranged to be essentially aligned with one another, while second portion 32 is generally laterally offset to one side. Coin race 28 will include a floor 37 arranged to be downwardly sloping when coin race assembly 10 is installed in an intended orientation in a machine. In other configurations, a coin race assembly in accordance with the present invention would not have to include a floor 37. For example, a coin race assembly in accordance with the present invention may alternatively define a vertical coin path, rather than a downwardly sloping generally horizontal path as depicted relative to coin race 28 of assembly 10.

Additionally, in the depicted preferred embodiment, the contours of second portion 32 are generally defined by curvilinear surfaces on the entrance end 38 and on the exit end 40 of deflection contour 34. Cover 26, as can best be seen in FIG. 3, includes a generally curvilinear internal contour 42 which cooperates with deflection contour 34 to define second portion 32 of coin race 28. Also as best depicted in FIG. 3, curvilinear surfaces 38 on the entrance end of second portion 32 of coin race 28 are preferably formed by a plurality of generally parallel ridges or fins 44 which define relative recesses 46 therebetween. At the relatively inner extent of the recesses 46 are further recesses or an aperture 48. In one particularly preferred embodiment, as depicted, the inner extent of recesses 46 will engage an aperture 48 which extends generally perpendicular to the path formed by first portion 30 of coin race 28. Aperture 48, thereby defines a ledge 51 between the inner extent of recesses 46 and second portion 32 of coin race 28. The forming of ledge 51 serves to provide a restricting surface which will tend to capture the end of any probe inserted into coin race 28, which will thereby help to prevent the movement of the probe into coin race 28. Further, aperture 48 provides only a very restricted area through which a probe might exit the confines of housing assembly 22.

The exact dimensions and configuration of coin race 28 may be selected in relation to the particular coins designed to be received within coin race assembly 10 and the intended operating orientation. For example, the contours of surfaces 38, 40, and 42 defining the second portion 32 of coin race 28 may be selected in relation to an anticipated size of coin to be received. As a guideline, coin race 28 will preferably be formed to define spaces which do not represent even multiples of the widths of the coins to be received. Coin race 28 will also be formed to provide sufficient deflection of the coin race so as to complicate efforts to insert probes along the race. For example, in one preferred embodiment designed to be utilized with United States coinage of quarters, dimes, and nickels, the distance 37 from coin slot entrance 27 to the beginning of entrance curvilinear surfaces 38 is approximately 0.25 inch, and the distance 50 between entrance curvilinear surfaces 38 and the end of exit curvilinear surfaces 40 is preferably approximately 1.25 inch; while deflection contour 34 extends approximately 0.25 inch from sidewall surface 54 forming a sidewall of first portion 30. Coin race 28 preferably has a dimension 41 of approximately 0.130 inch proximate the maximum deflection point 56 of deflection contour 34. Floor 37 is arranged to establish approximately a 15 degree downward slope to facilitate rolling a coin through coin race 28.

As can be seen in FIG. 3, coin race cover 26 includes an inwardly-extending projection 58 to guide a coin toward third portion 36. Cover 26 also includes an opening or "cutaway" area which forms an aperture 62 when cover 26 is coupled to body portion 24 of coin race housing assembly 22. As can he seen in FIG. 1, aperture 62 includes a first area 62 which extends adjacent floor 37 of coin race 28 proximate first and second portions 32, 34 at a generally constant height, and then opens up to a dimension which is essentially open 62*b* proximate third portion 36. The exact height of aperture area 62*a* may be determined in response to the configuration of coin race 28 and the deflection allowed to each size of coinage to be received. In the depicted exemplary embodiment, aperture 62*a* extends approximately 0.42 inch above floor 37.

Recesses in the end of body 24 proximate third portion 26 will form apertures 63, 64 in housing assembly 22 when cover 26 is secured to body 24. In this preferred embodiment, cover 26 also includes a forward leg 39 which includes an inner surface 41 tapering toward apertures 63 and 64. In general, apertures may be provided adjacent coin race 28 where surfaces are not needed to guide or restrain passage of coins; with the exception that surfaces may also be provided to restrict the passage of probes potentially inserted into coin race 28 out of housing assembly 23 at locations where the probes might cause damage to the machine in which the coin race assembly is located.

The basic functioning of tamper resistant coin race assembly 10 is as follows. When a coin passes through entrance opening 27 and into first portion 30 of coin race 28, the coin will soon encounter the leading-edge curvilinear surface 38 of deflection contour 34, formed by fins 44, and will be deflected from first portion 30 to a laterally-offset path through second portion 32. The dimensions of coin race 28 will maintain the coin on an on-edge configuration, and downwardly-sloping floor 37 of coin race 28 will facilitate rolling movement of the coin along coin race 28. As the coin passes the maximum deflection point 56 in second portion 32, the curvilinear contour 42 and projection 58 of cover 26 will direct the rolling coin toward third portion 36 of coin race 28. As the moving coin leaves second portion 32, its path will facilitate its exiting of third portion 36 of coin race 28, and the resulting passage into entrance aperture 38 of coin collection assembly 12.

The resistance to tampering of coin race assembly 10 is a result of several features. A first significant feature is the open aperture 62 which extends adjacent coin race 28. As described earlier herein, aperture 62*b* preferably extends along at least a portion of first portion 30, and second portion 34 of coin race 28, and establishes a passageway from coin race 28 to the exterior of housing assembly 22. This opening, while not sufficiently large to allow exiting of the coins, substantially prevents the stuffing of paper, straws, or other unintended objects to block the path of coin race 28. Further, recesses 46 and aperture 48 at the entrance to second portion 34 make the insertion of probes, such as rods or other objects, into coin race assembly 10 more difficult. In many cases, such objects will be retained on the backside of deflection contour 34 by lip 51, avoiding the insertion of the objects into the coin path. Even if a vandal is successful in getting a rod or other object past recesses 56 and past second portion deflection point 56, aperture 62 eliminates most surface area against which blocking materials could otherwise be supported. Further, the taper of inner surface 41 proximate apertures 63, 64 facilitates the exiting of any foreign objects through apertures 63 or 64.

In this particularly preferred embodiment, and as previously indicated, a coin receptor slot covering assembly 16 is coupled to a hinged segment 18 of coin collection assembly 12 so as to be moveable in response to pivoting motion of hinged segment 18 relative to another segment, such as at 20. This has two primary functions relative to this embodiment. First, if the vandal is successful in traversing the path of coin race 28 with stuffing material, and attempts to stuff an extremely large volume of material into coin race 28, the material will eventually engage the portion 68 of covering assembly 16 proximate aperture 62, and will cause deflection of assembly 16 so as to bring the entrance aperture 64 in assembly 16 out of registry with entrance aperture 27 of coin race assembly 10, thereby preventing further insertion of coins. Additionally, in the manner in which such mechanisms are conventionally known to operate, the movement of hinged segment 18, such as through use of the coin return lever, will again cause the change of position of coin receptor slot 64 of plate 16 from registry with coin entrance 27, again making the insertion of foreign items more difficult.

Figure 5:
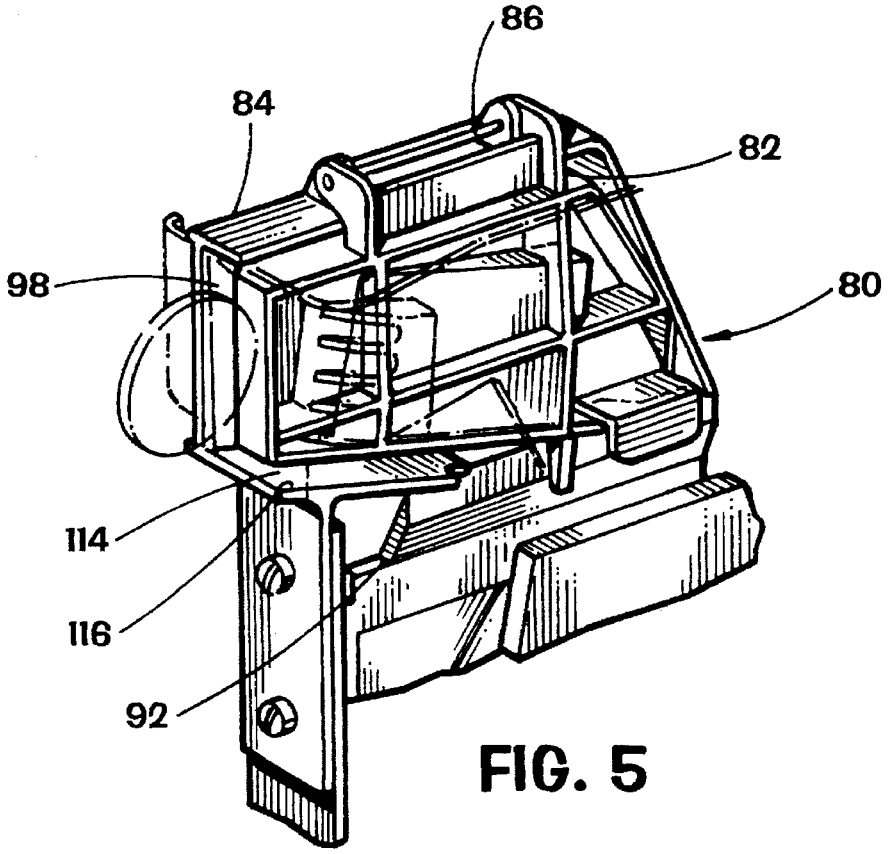
FIG. 5 depicts an alternative construction of a coin race assembly in accordance with the present invention.
Figure 6:
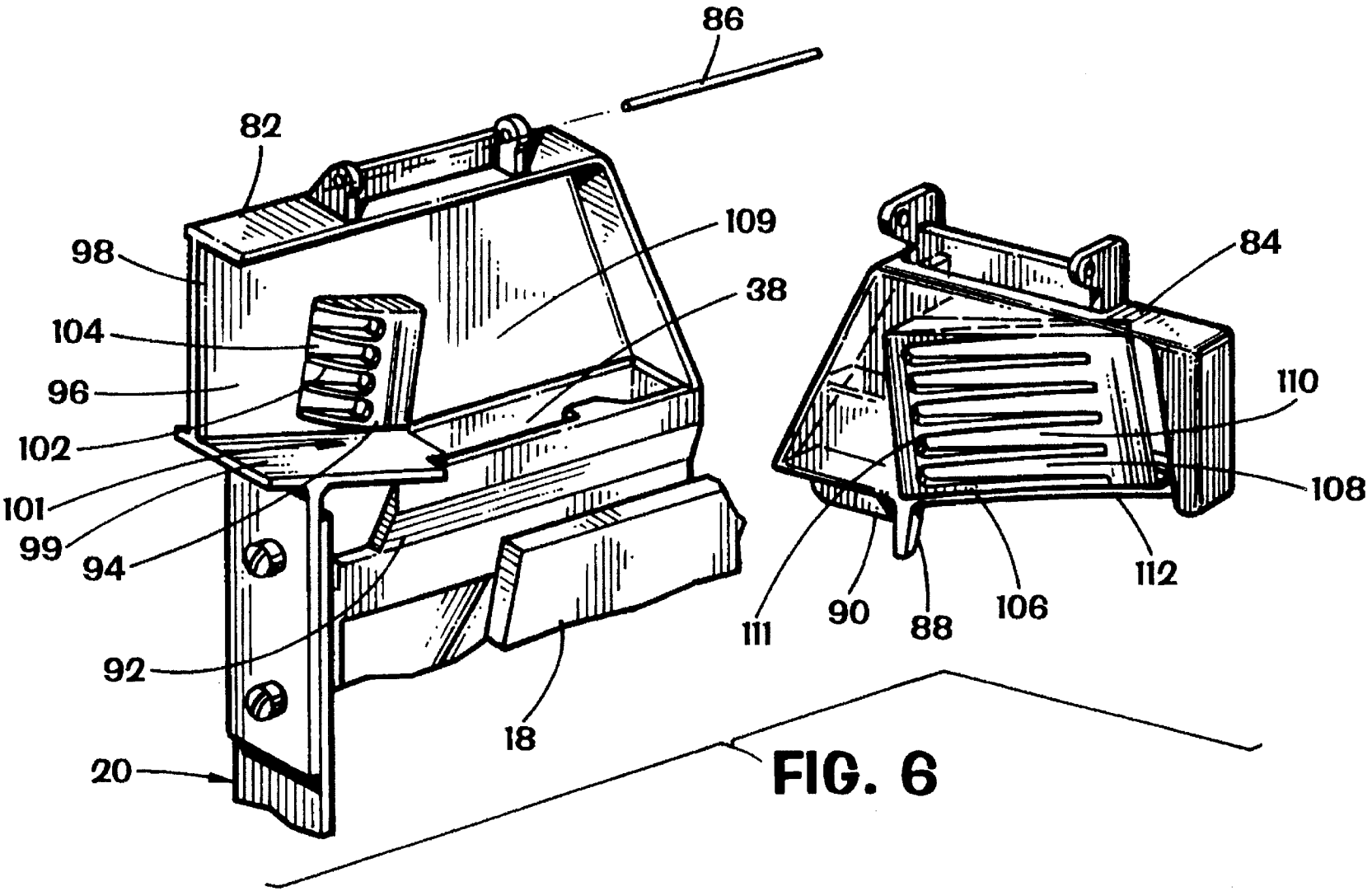
FIG. 6 depicts the coin race assembly of FIG. 5 in an exploded view.

Referring now to FIGS. 5 and 6, therein is depicted an alternative construction of a coin race assembly, indicated generally at 80. The theory of operation of coin race assembly 80 is similar to that discussed with respect to coin race assembly 10 of FIGS. 1–4. Coin race assembly 80, however, is of a simplified configuration, but still maintains many of the advantages of the previously described embodiment. Additionally, coin race assembly 80 is of a configuration which facilitates retrofitting of many existing coin race assemblies to minimize vandalism. Coin race assembly 80 includes a body portion 82 and a cover portion 84 which are coupled together in a hinged relationship, such as through a hinge pin 86. Cover portion 84 includes a downwardly extending actuation lug 88 and flange 90 which engage opposite sides of a hinged segment 92 of coin collection assembly 12. Hinged segment 92 may represent the same component as that identified as element 18 relative to the embodiment of FIGS. 1–4, or, as in the depicted embodiment, may represent a separate hinged element of coin collection assembly 12, as will be understood by those skilled in the art. Hinged segment 92 will preferably be a segment which, when pivoted relative to body portion 20, will prevent acceptance of coins by coin collection assembly 12.

A first deflection block 94 is secured within body portion 82 along a sidewall 96 forming one side of a coin receptor slot 98 and a first portion 99 of a coin race 100. Once again, first deflector block provides a generally curvilinear contour to define a second portion 101 of coin race 100. Such second portion 101 is laterally offset from sidewall 96. Deflection block 94 again preferably includes a plurality of fins 102 defining recesses 104 therebetween to facilitate capture of an inserted probe. Further, each recess 104 preferably serves to define an undercut 105 to restrict movement of a probe in recess 104 outwardly into second portion 101 of coin race 100.

Cover portion 84 includes a second deflection block 106 secured thereto. Second deflection block 106 defines the other side of coin race 100, and includes a curvilinear inner surface 108 configured to guide a coin from first portion 99 of coin race 100 proximate entrance aperture 98, around first deflection block 94, and to a rearward side of deflection block 94 to a third portion 109 of coin race 100, where a coin may drop into entrance aperture 38 of coin receiving assembly 12. Deflection block 108, in this embodiment, preferably includes a plurality of elongated tapered grooves 110 which widen in the direction of the path a coin will follow through coin race assembly 80. Each tapered groove 110 preferably ends in an undercut section 111 relative to inner surface 108 of second deflection block 106 to again restrict lateral movement of a probe into coin race 100. Such grooves 110, like recesses 104 in first deflection block 94, serve to tend to restrict any probe or similar item which a vandal would attempt to insert along coin race 100.

Cover 84 is preferably configured to have a lower surface 112 below second deflection block 108 which defines a gap 114 above coin race floor 116. Gap 114, once again, will serve to make it more difficult to stuff paper or other foreign material along coin race 100.

Further, the cooperative engagement between cover 84 and hinged segment 92 further prevents defrauding of customers through stuffing of coin race assembly 80. If a vandal attempts to stuff a large volume of material along coin race 100, because of the pivotable engagement between cover 84 and body portion 82, cover 84 will pivot outwardly, moving hinged segment 92 with it, through the cooperative engagement of tab 88 and flange 90 with hinged segment 92, thereby causing coin collection assembly 12 to not accept deposited coins. Further, the inclusion of a slot receptor deflection plate assembly 16 coupled to coin collection assembly 12, in the manner previously described, will further facilitate frustration of the vandal's attempts. The pivoting movement of segment 92 relative to body portion 20 will similarly cause movement of segment 18 (or any other appropriate segment depending upon the particular embodiment of coin receiving apparatus utilized), to cause lateral movement of coin receptor blocking assembly 16, again restricting access to coin entrance 98.

Many modifications and variations may be made in the techniques and structures described and illustrated herein without departing from the spirit and scope of the present invention. Accordingly, it should be readily understood that the embodiments described and illustrated herein are illustrative only, and are not to be considered as limitations upon the scope of the present invention.

What is claimed is:

1. A coin receiving apparatus, comprising:

a housing assembly defining a coin race through which a coin will pass to reach a coin exit;

said coin race having a first portion, a second portion laterally offset from said first portion in a first direction, and a third portion laterally offset from said second portion in a second direction;

said housing assembly further including a coin deflection wall conformed to guide said coin from said first portion to said second portion and to said third portion without separating coins of different sizes;

said coin deflection wall including an aperture therethrough providing communication from said coin race to a location removed from said coin race;

a coin collection assembly operatively coupled to said housing assembly to receive a coin therefrom;

a coin return assembly operatively coupled to said coin collection assembly; and a coin slot blocking element operatively coupled to said coin return assembly, said coin return blocking element operatively coupled to selectively at least partially block passage to inlet end of said coin race.

* * * * *